US009097250B2

(12) United States Patent
Fujiki et al.

(10) Patent No.: US 9,097,250 B2
(45) Date of Patent: Aug. 4, 2015

(54) PUMP ROTOR

(71) Applicant: YAMADA MANUFACTURING CO., LTD., Kiryu-shi, Gunma-ken (JP)

(72) Inventors: Kenichi Fujiki, Isesaki (JP); Masato Izutsu, Isesaki (JP)

(73) Assignee: YAMADA MANUFACTURING CO., LTD., Kiryu-Shi, Gunma-Ken (JP)

( * ) Notice: Subject to any disclaimer, the term of this patent is extended or adjusted under 35 U.S.C. 154(b) by 217 days.

(21) Appl. No.: 13/670,358

(22) Filed: Nov. 6, 2012

(65) Prior Publication Data

US 2013/0112028 A1 May 9, 2013

(30) Foreign Application Priority Data

Nov. 8, 2011 (JP) ..... 2011-244512

(51) Int. Cl.

| | |
|---|---|
| ***F04C 2/00*** | (2006.01) |
| ***F04C 18/00*** | (2006.01) |
| ***F01C 21/00*** | (2006.01) |
| ***F04C 15/00*** | (2006.01) |
| ***F01C 1/18*** | (2006.01) |
| ***F04C 2/08*** | (2006.01) |
| ***F04C 2/10*** | (2006.01) |

(52) U.S. Cl.

CPC ..... *F04C 2/084* (2013.01); *F04C 2/102* (2013.01); *Y10T 74/19972* (2015.01)

(58) Field of Classification Search

CPC ..... F04C 2/084; F04C 2/102; F01C 1/084
USPC ..... 418/166, 171, 190, 206.5
See application file for complete search history.

(56) References Cited

U.S. PATENT DOCUMENTS 5,405,299 A * 4/1995 Kubo et al. ..... 474/205

FOREIGN PATENT DOCUMENTS

JP 2011-017318 A 1/2011

* cited by examiner

*Primary Examiner* — Kenneth Bomberg
*Assistant Examiner* — Deming Wan
(74) *Attorney, Agent, or Firm* — McGinn IP Law Group, PLLC

(57) ABSTRACT

A pump rotor is an inner rotor of an internal gear pump, the inner rotor having a tooth profile, wherein a half-tooth portion of the tooth profile is formed of three tooth-profile formation circles that are elliptical or true-circular. Two of the tooth-profile formation circles are a combination of a small tooth-profile formation circle and a large tooth-profile formation circle in which the small tooth-profile formation circle is inscribed and is entirely included. A portion of the small tooth-profile formation circle forms an addendum portion of the half-tooth portion. A portion of the large tooth-profile formation circle in which the small tooth-profile formation circle is inscribed and is entirely included forms an engagement portion of the half-tooth portion. A portion of another tooth-profile formation circle that circumscribes the large tooth-profile formation circle forms a dedendum portion of the half-tooth portion.

13 Claims, 7 Drawing Sheets

FOUR ELLIPTICAL TOOTH-PROFILE FORMATION CIRCLES

FOUR TRUE-CIRCULAR TOOTH-PROFILE FORMATION CIRCLES

TWO ELLIPTICAL AND TWO TRUE-CIRCULAR TOOTH-PROFILE FORMATION CIRCLES

EXAMPLE OF PUMP ROTOR ACCORDING TO PRESENT INVENTION

COMPARATIVE PRODUCT (PUMP ROTOR FORMED WITH TROCHOIDAL CURVES)

PUMP ROTOR

BACKGROUND OF THE INVENTION

1. Field of the Invention

The present invention relates to a pump rotor capable of increasing a discharge amount and improving durability without increasing an outer diameter or an axial thickness of a rotor.

2. Description of the Related Art

In rotors of the related art such as a trochoidal gear used in an internal gear pump such as an oil pump, the number of teeth is practically restricted by specifications such as a dedendum diameter of an inner rotor and an amount of eccentricity relative to an outer rotor. Thus, the number of teeth can be increased or decreased within a narrow range. Moreover, if the dedendum diameter, amount of eccentricity, and number of teeth described above are determined, a theoretical discharge amount is practically determined.

In a trochoidal rotor of the related art, in order to increase a theoretical discharge amount, a method of increasing an amount of eccentricity between an inner rotor and an outer rotor to increase the diameter of the rotor, or increasing the thickness of the rotor without changing the amount of eccentricity and the rotor diameter is used. However, in either method, the rotor size increases, which may deteriorate frictional properties.

Japanese Patent Application Laid-open No. 2011-17318 discloses an example of a technique for solving such a problem. The invention disclosed in Japanese Patent Application Laid-open No. 2011-17318 will be described briefly. First, the invention relates to a rotor in which the degree of freedom in setting a tooth height is increased to increase a theoretical discharge amount of a pump. Moreover, a plurality of ellipses that form the tooth profile includes a predetermined number of combinations of ellipses that have an appropriate size such that formed teeth have a larger tooth height than that of an inner rotor that uses cycloidal curves or trochoidal curves to form a tooth profile thereof.

As in the configuration described above, in the inner rotor, an ideal tooth profile is obtained by forming each of the tooth profiles of an addendum portion, a dedendum portion, and an engagement portion (a portion that connects the addendum portion and the dedendum portion) that engages with an outer rotor using a curve (a curve having a larger radius of curvature) that extends along the longer axis of an ellipse.

In a tooth profile of FIG. 4 disclosed in Japanese Patent Application Laid-open No. 2011-17318, an addendum portion 2*a* and a dedendum portion 2*b* are formed both by a curve that extends along the longer axis of an ellipse. Thus, it is possible to increase the areas of the addendum and the dedendum in contact with the teeth of an outer rotor and improve a protection effect of the addendum and the dedendum. Moreover, as shown in FIG. 4 disclosed in Japanese Patent Application Laid-open No. 2011-17318, by forming an engagement portion 2*c* using a curve that extends along the longer axis of an ellipse, it is possible to sufficiently increase a tooth height h.

A rotor of an internal gear pump disclosed in Japanese Patent Application Laid-open No. 2011-17318 will be compared with a general rotor that uses trochoidal curves. FIG. 12 disclosed in Japanese Patent Application Laid-open No. 2011-17318 shows a pump rotor in which an inner rotor having eight teeth and an outer rotor having 9 teeth are combined.

Specifications of the tooth profile of Japanese Patent Application Laid-open No. 2011-17318 are shown below.

Outer Diameter of Outer Rotor: ϕ60.0 mm

Large Diameter of Outer Rotor (Dedendum Circle Diameter): ϕ52.0 mm

Small Diameter of Outer Rotor (Addendum Circle Diameter): ϕ38.4 mm

Large Diameter of Inner Rotor (Addendum Circle Diameter): ϕ45.2 mm

Small Diameter of Inner Rotor (Dedendum Circle Diameter): ϕ21.6 mm

Inner Diameter of Inner Rotor: ϕ15.0 mm

Rotor Thickness: 15 mm

Amount of Eccentricity e: 3.4 mm (Tooth Height 2e: 6.8 mm)

A theoretical discharge amount of the internal gear pump disclosed in Japanese Patent Application Laid-open No. 2011-17318 is 12.3 $cm^3$/rev.

As a comparative product for the internal gear pump disclosed in Japanese Patent Application Laid-open No. 2011-17318, a pump rotor having a tooth profile that uses trochoidal curves shown in FIG. 15 disclosed in Japanese Patent Application Laid-open No. 2011-17318 is used. FIG. 15 disclosed in Japanese Patent Application Laid-open No. 2011-17318 shows a pump rotor having a tooth profile of the related art. The specifications of the comparative product are shown below.

Outer Diameter of Outer Rotor: ϕ60.0 mm

Large Diameter of Outer Rotor: ϕ52.0 mm

Small Diameter of Outer Rotor: ϕ39.6 mm

Large Diameter of Inner Rotor: ϕ45.8 mm

Small Diameter of Inner Rotor: ϕ33.4 mm

Rotor Thickness: 15 mm

Amount of Eccentricity e: 3.1 mm (Tooth Height 2e: 6.2 mm)

A discharge amount of the comparative product is 11.4 $cm^3$/rev.

Consequently, the rotor disclosed in Japanese Patent Application Laid-open No. 2011-17318 has a larger tooth height than that of the comparative product by extending the tooth height toward the inner side. Moreover, the theoretical discharge amount is increased.

As described above, Japanese Patent Application Laid-open No. 2011-17318 discloses a rotor of which the theoretical discharge amount is increased by increasing the tooth height. Moreover, in order to increase the tooth height, each of the tooth profiles of the addendum portion, the dedendum portion, and the engagement portion is formed using a curve that extends along the longer axis of an ellipse so that an ideal tooth profile is obtained. However, since the tooth profile is formed using ellipses that are smaller than a formation tooth profile, ellipses that partially overlap each other are connected approximately at 90°. The radius of curvature decreases near the inflection point of a connecting portion between a circular arc of the addendum and a circular arc of the engagement portion, the shape changes abruptly, and the tooth profile is not sufficiently smooth.

Moreover, since the teeth angle of the engagement portion increases due to an increase in the tooth height, an engagement range between the engagement portion and the outer rotor decreases. As a result, a force that presses the outer rotor is concentrated on a small area, and surface pressure increases. Moreover, since the outer rotor is driven in a state where a sliding factor is large, durability decreases. Moreover, since the addendum of the inner rotor and the dedendum of the outer rotor are closely situated in a large area of a deepest engagement portion, oil may be unable to find its way when the oil is discharged, and pumping loss increases.

SUMMARY OF THE INVENTION

Further, noise generated when rotors engage with each other tends to increase, and noise reduction properties are not satisfactory. An object (a technical problem to be solved) of the present invention is to provide an oil pump rotor capable of increasing a discharge amount and improving durability without increasing an outer diameter or an axial thickness of a rotor.

Therefore, as a result of intensive studies to solve the above-described problem, the present inventor has solve the problem by providing a pump rotor, as a first aspect of the present invention, which is an inner rotor of an internal gear pump, the inner rotor having a tooth profile, wherein a half-tooth portion of the tooth profile is formed of three tooth-profile formation circles that are elliptical or true-circular, two of the tooth-profile formation circles are a combination of a small tooth-profile formation circle (first small tooth-profile formation circle) and a large tooth-profile formation circle (second tooth-profile formation circle) in which the small tooth-profile formation circle is inscribed and is entirely included, a portion of the small tooth-profile formation circle (first small tooth-profile formation circle) forms an addendum portion of the half-tooth portion, a portion of the large tooth-profile formation circle (second tooth-profile formation circle) in which the small tooth-profile formation circle (first small tooth-profile formation circle) is inscribed and is entirely included forms an engagement portion of the half-tooth portion, and a portion of another tooth-profile formation circle (third tooth-profile formation circle) that circumscribes the large tooth-profile formation circle (second tooth-profile formation circle) forms a dedendum portion of the half-tooth portion.

The present inventor has solved the problem by providing a pump rotor, as a second aspect of the present invention, which is an inner rotor of an internal gear pump, the inner rotor having a tooth profile, wherein a half-tooth portion of the tooth profile is formed of four tooth-profile formation circles that are elliptical or true-circular, the four tooth-profile formation circles include first and second combinations, each combination being constituted by two of the tooth-profile formation circles formed of a small tooth-profile formation circle (first small tooth-profile formation circle, third small tooth-profile formation circle) and a large tooth-profile formation circle (second tooth-profile formation circle, fourth tooth-profile formation circle) in which the small tooth-profile formation circle (first small tooth-profile formation circle, third small tooth-profile formation circle) is inscribed and is entirely included, a portion of the small tooth-profile formation circle (first small tooth-profile formation circle) of the first combination forms an addendum portion of the half-tooth portion, a portion of the small tooth-profile formation circle (third small tooth-profile formation circle) of the second combination forms a dedendum portion the half-tooth portion, and a portion of the other large tooth-profile formation circle (second tooth-profile formation circle, fourth tooth-profile formation circle) forms an engagement portion of the half-tooth portion while circumscribing.

The present inventor has solved the problem by providing the pump rotor according to the first or second aspect, as a third aspect, in which the tooth-profile formation circles are formed of a combination of ellipses only. The present inventor has solved the problem by providing the pump rotor according to the first or second aspect, as a fourth aspect, in which the tooth-profile formation circles are formed of a combination of true circles only. The present inventor has solved the problem by providing the pump rotor according to the first or second aspect, as a fifth aspect, in which the tooth-profile formation circles are formed of a combination of an ellipse and a true circle.

In the pump rotor according to the first aspect, it is possible to increase the number of teeth without increasing the addendum diameter, the dedendum diameter, the amount of eccentricity, that is, without increasing the tooth height, as compared to a general trochoidal rotor. Moreover, it is possible to increase a discharge amount without increasing the outer diameter or the axial thickness of the rotor.

Further, by increasing the number of teeth, it is possible to obtain a pump rotor with small pulsation and low noise. Moreover, due to the inscribing ellipse or true circle, it is possible to increase the radius of curvature near the inflection point of a connecting portion between a circular arc of the addendum and a circular arc of the engagement portion and to make the connecting portion smooth. Furthermore, since the teeth angle of the engagement portion decreases, an engagement range between the engagement portion and the outer rotor increases. As a result, it is possible to distribute the force that presses the outer rotor and to suppress the surface pressure.

Moreover, since the outer rotor is driven in a state where a rolling factor is larger than a sliding factor, the durability is improved. Since the addendum of the inner rotor and the dedendum of the outer rotor are closely situated in a small area of a deepest engagement portion, it is possible to push out oil efficiently when discharging the oil and to decrease pumping loss. Further, it is possible to decrease the noise generated when rotors engage with each other and to improve noise reduction properties. Since the pump rotor drawn according to the present invention has the same size as that of the general rotor drawn with trochoidal curves, the pump rotor according to the present invention can be easily modified to a rotor having a large theoretical discharge amount without changing the size of a rotor chamber of a housing.

In the second invention, four tooth-profile formation circles are used, and one of the combinations of two tooth-profile formation circles includes a small tooth-profile formation circle that is included in the other tooth-profile formation circle so as to be partially in contact with each other, and a portion of the small tooth-profile formation circle forms a dedendum portion of the half-tooth portion. Therefore, it is possible to form the tooth profile with higher accuracy.

In the third aspect, since the tooth-profile formation circles are formed of a combination of ellipses only, it is possible to allow the addendum portion to have a flat shape and to obtain a tooth profile that provides satisfactory mechanical strength. In the fourth aspect, since the tooth-profile formation circles are formed of a combination of true circles only, it is possible to simplify a tooth profile forming step. In the fifth aspect, since the tooth-profile formation circles are formed of a combination of an ellipse and a true circle, it is possible to form a tooth profile with higher accuracy.

DESCRIPTION OF THE PREFERRED EMBODIMENTS

Hereinafter, embodiments of the present invention will be described with reference to drawings. A pump rotor according to the present invention is a gear rotor that constitutes an internal gear pump. The pump rotor of this type generally includes a combination of an inner rotor and an outer rotor in which the inner rotor is disposed at an inner side thereof and which rotates.

Figure 5:
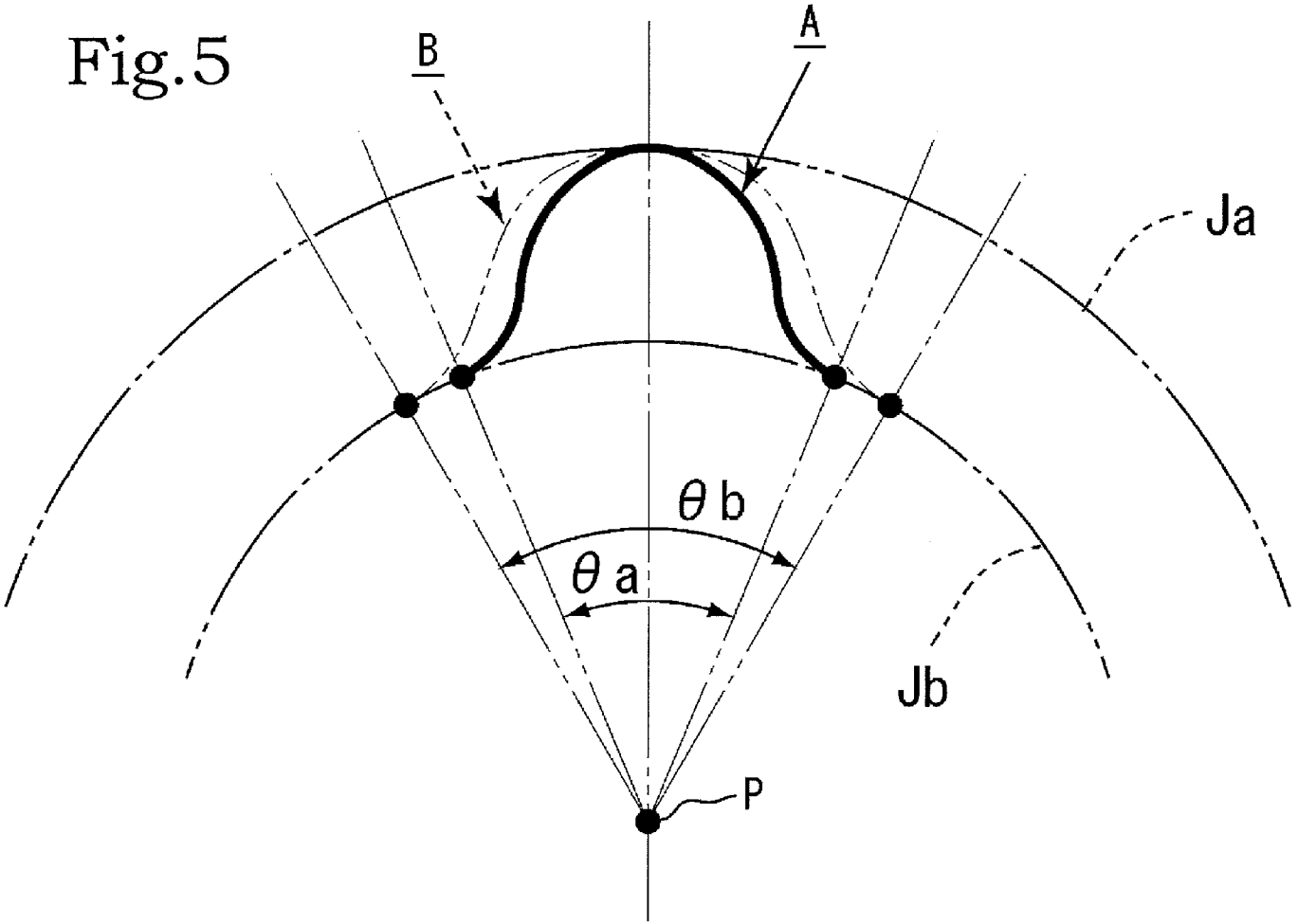
FIG. 5 is a view for comparing the tooth profile of an inner rotor of the present invention with the tooth profile of a general trochoidal inner rotor.

The present invention mainly relates to an inner rotor of a pump rotor. Hereinafter, the inner rotor of a pump rotor will be mainly described. FIG. 5 shows a tooth profile A of the pump rotor (the inner rotor) according to the present invention as compared to a tooth profile B of a general inner rotor drawn with a trochoidal curve. The tooth profile A of the present invention and the trochoidal curve tooth profile B are disposed at the same position.

An addendum circle Ja and a dedendum circle Jb are the same between the tooth profile A of the pump rotor (the inner rotor) drawn according to the present invention and the tooth profile B of the general inner rotor drawn with the trochoidal curve. That is, when a pitch angle of one tooth (a portion that extends from a dedendum point to an adjacent dedendum point through an addendum point) of the pump rotor drawn according to the present invention without changing an addendum diameter and a dedendum diameter is "θa", and a pitch angle of one tooth of the general inner rotor drawn with the trochoidal curve is "θb", a relation of "θb>θa" is satisfied.

By setting the addendum circle Ja and the dedendum circle Jb so as to be identical to those of the general trochoidal curve inner rotor, it is possible to easily increase the number of teeth while maintaining an amount of eccentricity. Thus, the sizes of the pump rotor (the inner rotor) and the outer rotor of the present invention are not changed, and the respective central positions are not changed. That is, the pump rotor of the present invention can be easily applied to a pump without increasing the outer diameter of the outer rotor and changing the size of a rotor chamber and a shaft center position of a housing that uses the general rotor drawn with the trochoidal curve. Moreover, a theoretical discharge amount can be increased.

Next, a drawing method for allowing the tooth profile A of the pump rotor (the inner rotor) according to the present invention so as to satisfy the relation of "θb>θa" and making the addendum circle Ja and the dedendum circle Jb the same as those of the general trochoidal curve inner rotor will be described. A half-tooth portion A1 is formed of a plurality of large and small tooth-profile formation circles (specifically, a large tooth-profile formation circle C and a small tooth-profile formation circle Cs). The half-tooth portion A1 refers to one of bilaterally symmetrical portions obtained by dividing an addendum portion 1 along a diameter line Lc that passes through a diameter center P of the pump rotor. That is, the tooth profile A is formed of both bilaterally symmetrical half-tooth portions A1.

The plurality of tooth-profile formation circles C and Cs is made up of at least three tooth-profile formation circles. Further, two of the tooth-profile formation circles are a combination of a small tooth-profile formation circle Cs and a large tooth-profile formation circle C that are partially in contact with each other so that the small tooth-profile formation circle Cs is included in the tooth-profile formation circle C. Moreover, a portion of the small tooth-profile formation circle Cs forms an addendum portion of the half-tooth portion A1 of the tooth profile A, and the other large tooth-profile formation circles C are partially smoothly connected so as to extend along the dedendum from the addendum of the half-tooth portion Al.

Further, when the half-tooth portion A1 is formed of four large and small tooth-profile formation circles C and Cs, the half-tooth portion A1 is formed of two combinations of a large tooth-profile formation circle C and a small tooth-profile formation circle Cs that is included in the large tooth-profile formation circle C so as to be partially in contact with the large tooth-profile formation circle C. Moreover, one of the two small tooth-profile formation circles Cs forms an addendum of the half-tooth portion A1, and the other tooth-profile formation circle Cs forms a dedendum of the half-tooth portion A1.

The large and small tooth-profile formation circles C and Cs may be an ellipse or a true circle. In the present invention, a plurality of embodiments of the large and small tooth-profile formation circles C and Cs shown below is possible depending on a combination of an ellipse and a true circle. First, in a first embodiment, the plurality of large and small tooth-profile formation circles C and Cs that form the half-tooth portion A1 includes a combination of ellipses only (see FIG. 1).

The half-tooth portion A1 is formed of three tooth-profile formation circles C, and all of the large and small tooth-profile formation circles C and Cs are ellipses (see FIGS. IB, 1C, and the like). As described above, one of the three tooth-profile formation circles is a small tooth-profile formation circle Cs that is smaller than the other large tooth-profile formation circles C. These plural (three) tooth-profile formation circles C (including the small tooth-profile formation circle Cs) form the addendum portion 1, the engagement portion 2, and the dedendum portion 3 of the half-tooth portion A1.

Moreover, in the first embodiment, for the sake of convenience of explanation, among the three large and small elliptical tooth-profile formation circles C and Cs used, the other two large tooth-profile formation circles C excluding the small tooth-profile formation circle Cs will be referred to as first and second elliptical tooth-profile formation circles C1 and C2 (see FIG. 10). Moreover, a portion of the small tooth-profile formation circle Cs forms the addendum portion 1 of the half-tooth portion A1. Furthermore, a portion of each of the first and second tooth-profile formation circles C1 and C2 forms the engagement portion 2 in a continuous form. Furthermore, another portion of the second tooth-profile formation circle C2 forms the dedendum portion 3.

The small tooth-profile formation circle Cs is included in the first tooth-profile formation circle C1 so as to be partially in contact with the first tooth-profile formation circle C1. That is, the small tooth-profile formation circle Cs is disposed at an inner side of the first elliptical tooth-profile formation circle C1, and both ellipses are partially in contact with each other. The first tooth-profile formation circle C1 is larger than a tooth profile that is formed. That is, the first tooth-profile formation circle C1 is an ellipse that substantially includes the outline of the tooth profile and expands toward an outer side of the outline of the tooth profile.

Since the small tooth-profile formation circle Cs that constitutes the addendum portion 1 is inscribed in the first tooth-profile formation circle C1, the locus of the addendum portion 1 does not project outside in the diameter direction further than the first tooth-profile formation circle C1 that constitutes the engagement portion 2. As a result, it is possible to suppress a tip end position of the addendum portion 1 from projecting outside in the diameter direction and to prevent the tooth height from increasing.

Moreover, the engagement portion 2 is formed such that the small tooth-profile formation circle Cs that forms the addendum portion 1 is included in the first tooth-profile formation circle C1. Looking at the passing direction of an addendum central line which is the shorter axis of the small tooth-profile formation circle Cs in the addendum portion 1, the addendum central line first passes through the first tooth-profile formation circle C1 of the engagement portion 2 from the outer side in the diameter direction, subsequently passes through the small tooth-profile formation circle Cs of the addendum portion 1, also subsequently passes through the small tooth-profile formation circle Cs of the addendum portion 1, and finally passes through the first tooth-profile formation circle C1.

That is, a portion of the circumference of the small tooth-profile formation circle Cs that forms the addendum portion 1 gradually approaches the curve of the first tooth-profile formation circle C1 that includes the small tooth-profile formation circle Cs. The addendum portion 1 is connected to the engagement portion 2 at a position at which the small tooth-profile formation circle Cs of the addendum portion 1 is in contact with the first tooth-profile formation circle C1 of the engagement portion 2. Then, in the first tooth-profile formation circle C1 of the engagement portion 2, a portion that forms the engagement portion 2 gradually departs from the small tooth-profile formation circle Cs of the addendum portion 1.

The first tooth-profile formation circle C1 of the engagement portion 2 gradually approaches the small tooth-profile formation circle Cs of the addendum portion 1, and the small tooth-profile formation circle Cs of the addendum portion 1 gradually departs from the first tooth-profile formation circle C1 of the engagement portion 2 with the connecting portion interposed. As a result, the curve of the addendum portion 1 is connected to the curve of the engagement portion 2. Since the curves can be smoothly connected without decreasing the radius of curvature of the connecting portion, the engagement with the outer rotor is made smooth, the durability is improved, the noise generated when rotors engage with each other is decreased, and the noise reduction properties are improved.

Since the first tooth-profile formation circle C1 that forms the engagement portion 2 is an ellipse that is larger than the small tooth-profile formation circle Cs that forms the addendum portion 1, it is possible to increase the radius of curvature of the engagement portion 2, to allow the teeth of the engagement portion 2 to stand upright, and to decrease the thickness of the teeth. Accordingly, it is possible to decrease the pitch angle of the teeth.

When the small tooth-profile formation circle Cs that forms the addendum portion 1, the first tooth-profile formation circle C1 that forms the engagement portion 2, and the second tooth-profile formation circle C2 that forms the dedendum portion 3 are connected smoothly, the half-tooth portion A1 of the tooth profile A of the inner rotor is formed. Moreover, by disposing the half-tooth portions A1 bilaterally symmetrical to the diameter line Lc, it is possible to form the tooth profile A of one tooth of the inner rotor.

Figure 1A:
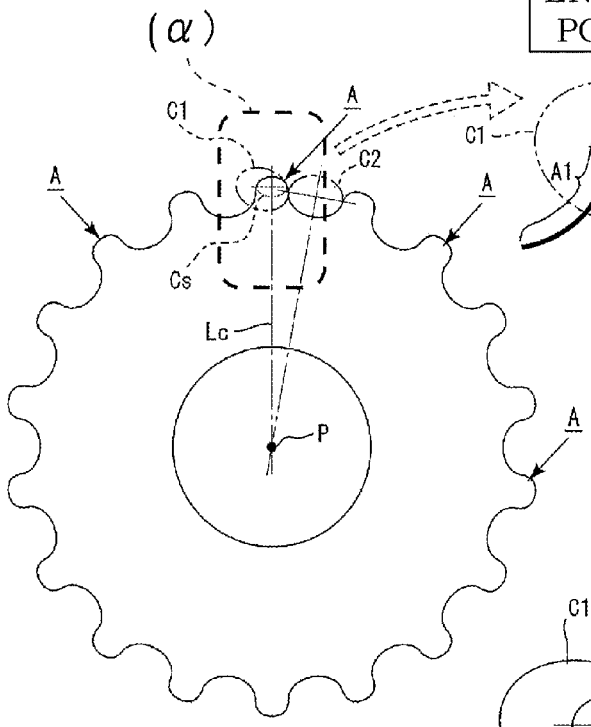
FIG. 1A is a front view of an inner rotor of a pump rotor according to a first embodiment of the present invention.
Figure 1B:
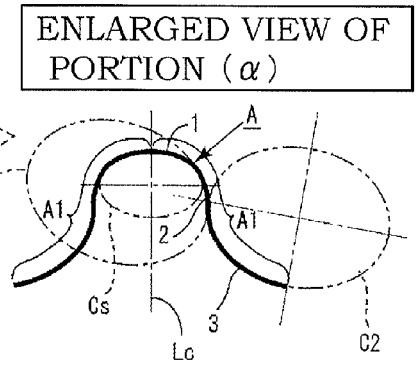
FIG. 1B is an enlarged view of a portion indicated by (a) in FIG. 1A.
Figure 1C:
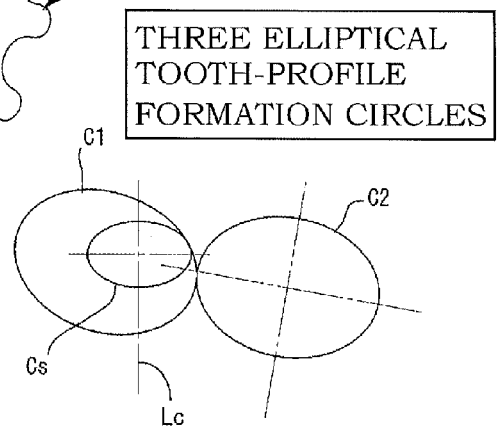
FIG. 1C is a view showing a state where elliptical tooth-profile formation circles and a small tooth-profile formation circle that form a tooth profile of the inner rotor according to the first embodiment are combined.
Figure 1D:
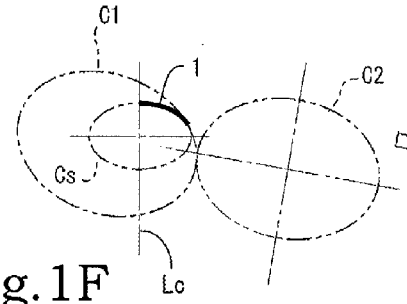
FIGS. 1D to 1F are views showing the steps in which a half-tooth portion of the tooth profile of the inner rotor according to the first embodiment is formed.
Figure 1E:
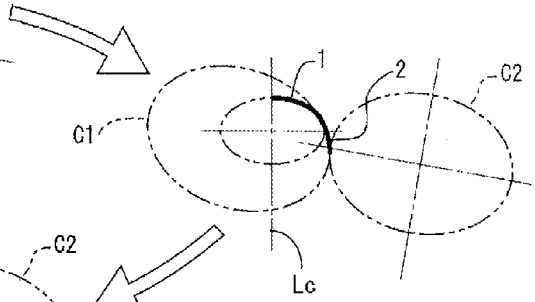
Figure 1F:
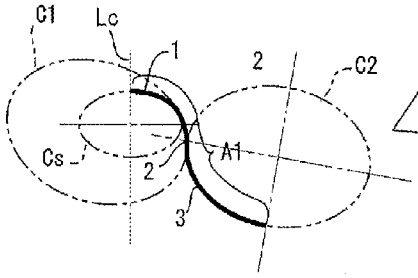
Figure 2A:
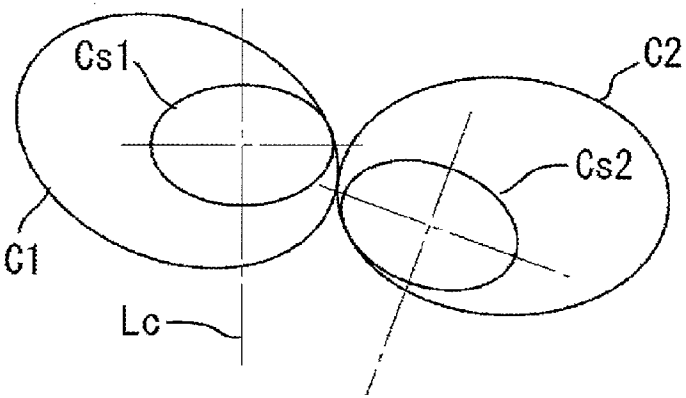
FIG. 2A is a view showing a state where elliptical tooth-profile formation circles and small tooth-profile formation circles that form a tooth profile of an inner rotor according to a second embodiment of the present invention are combined.
Figure 2B:
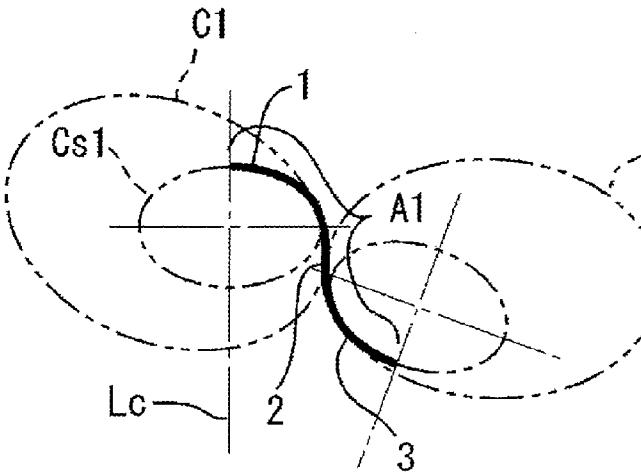
FIGS. 2B and 2C are views showing the steps in which the tooth profile of the inner rotor according to the second embodiment is formed from a half-tooth portion of the tooth profile.
Figure 2C:
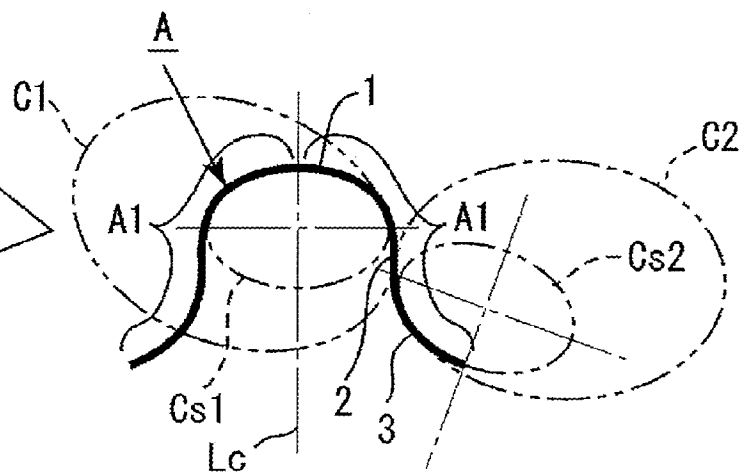

Next, a second embodiment of the present invention will be described with reference to FIG. 2. In the second embodiment, the half-tooth portion A1 is formed of four tooth-profile formation circles C, all of which are elliptical. First, in the second embodiment, for the sake of convenience, the four elliptical tooth-profile formation circles C will be referred to as first and second tooth-profile formation circles C1 and C2 and first and second small tooth-profile formation circles Cs1 and Cs2.

Moreover, a portion of the first small elliptical tooth-profile formation circle Cs1 forms the addendum portion 1 of the half-tooth portion A1. Further, a portion of each of the first and second elliptical tooth-profile formation circles C1 and C2 forms the engagement portion 2 in a continuous form. Furthermore, the second small elliptical tooth-profile formation circle Cs2 forms the dedendum portion 3.

In the configuration of the addendum portion 1, similarly to the first embodiment, the first small tooth-profile formation circle Cs1 is included in the first tooth-profile formation circle C1 that forms the engagement portion 2 so as to be partially in contact with the first tooth-profile formation circle C1, the first small tooth-profile formation circle Cs1 forms the addendum portion 1, and the first tooth-profile formation circle C1 forms a portion of the engagement portion 2.

Further, the second elliptical tooth-profile formation circle C2 forms the remaining portion of the engagement portion 2, and the second small tooth-profile formation circle Cs2 that is included in the second tooth-profile formation circle C2 so as to be partially in contact with each other forms the dedendum portion 3. When the first small tooth-profile formation circle Cs1 that forms the addendum portion 1, the first and second tooth-profile formation circles C1 and C2 that form the engagement portion 2, and the second small tooth-profile formation circle Cs2 that forms the dedendum portion 3 are connected smoothly, the half-tooth portion A1 of the tooth profile A of the inner rotor is formed. Moreover, by disposing the half-tooth portions A1 bilaterally symmetrical to the diameter line Lc, it is possible to form the tooth profile A of one tooth of the inner rotor.

Figure 3A:
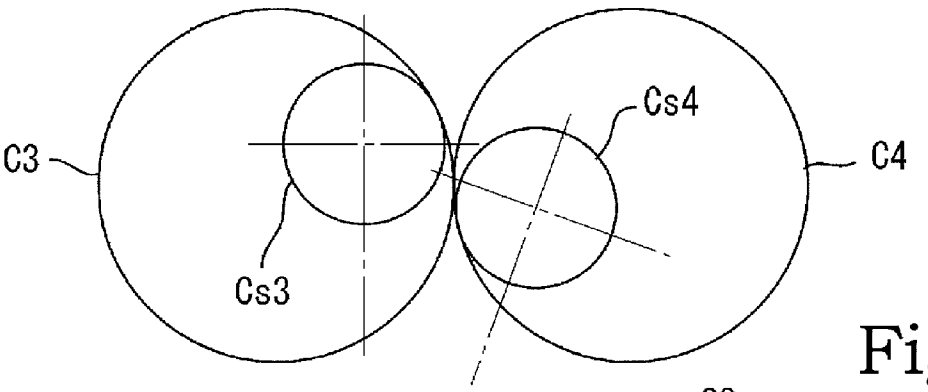
FIG. 3A is a view showing a state where true-circular tooth-profile formation circles and small tooth-profile formation circles that form a tooth profile of an inner rotor according to a third embodiment of the present invention are combined.
Figure 3B:
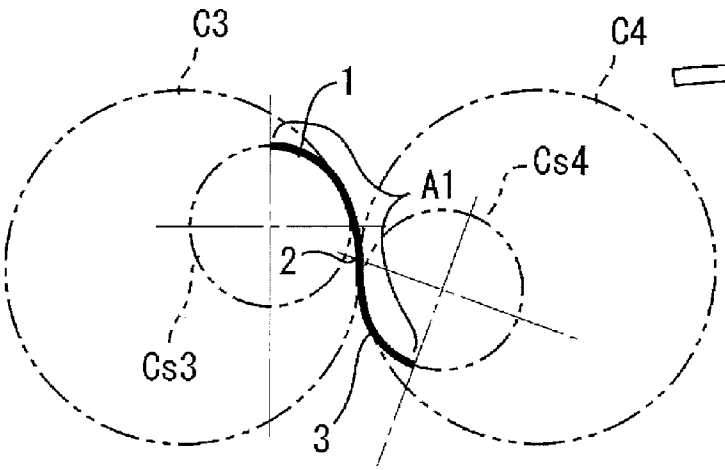
FIGS. 3B and 3C are views showing the steps in which the tooth profile of the inner rotor according to the third embodiment is formed from a half-tooth portion of the tooth profile.
Figure 3C:
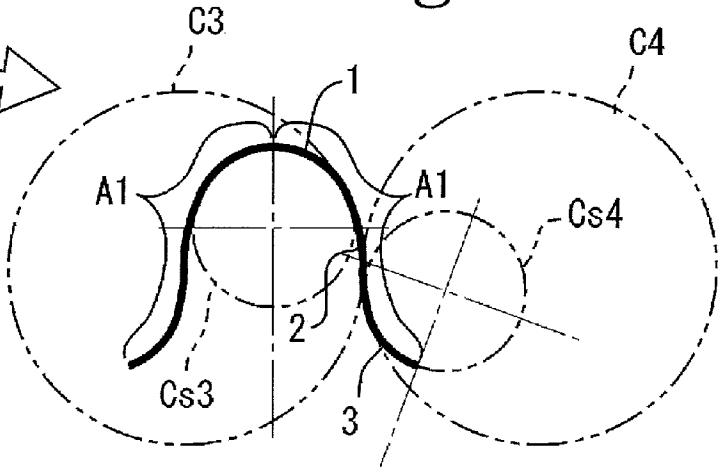

Next, a third embodiment of the present invention will be described with reference to FIG. 3. In the third embodiment, the half-tooth portion A1 is formed of four tooth-profile formation circles C all of which are true-circular. First, in the third embodiment, for the sake of convenience, the four true-circular tooth-profile formation circle C will be referred to as third and fourth true-circular tooth-profile formation circles C3 and C4 and third and fourth small true-circular tooth-profile formation circles Cs3 and Cs4.

Moreover, a portion of the third small true-circular tooth-profile formation circle Cs3 forms the addendum portion 1 of the half-tooth portion A1. Further, a portion of each of the third and fourth true-circular tooth-profile formation circles C3 and C4 forms the engagement portion 2. Furthermore, the fourth true-circular tooth-profile formation circle Cs4 forms the dedendum portion 3.

In the configuration of the addendum portion 1, similarly to the first embodiment, the third small tooth-profile formation circle Cs3 is included in the third tooth-profile formation circle C3 that forms the engagement portion 2 so as to be partially in contact with each other, the third small tooth-profile formation circle Cs3 forms the addendum portion 1, and the third tooth-profile formation circle C3 forms a portion of the engagement portion 2.

Further, the fourth true-circular tooth-profile formation circle C4 forms the remaining portion of the engagement portion 2, the fourth tooth-profile formation circle Cs4 that is included in the fourth tooth-profile formation circle C4 so as to be partially in contact with each other forms the dedendum portion 3. When the third small tooth-profile formation circle Cs3 that forms the addendum portion 1, the third and fourth tooth-profile formation circles C3 and C4 that form the engagement portion 2, and the fourth small tooth-profile formation circle Cs4 that forms the dedendum portion 3 are connected smoothly, the half-tooth portion A1 of the tooth profile A of the inner rotor is formed. Moreover, by disposing the half-tooth portions A1 bilaterally symmetrical to the diameter line Lc, it is possible to form the tooth profile A of one tooth of the inner rotor.

Figure 4A:
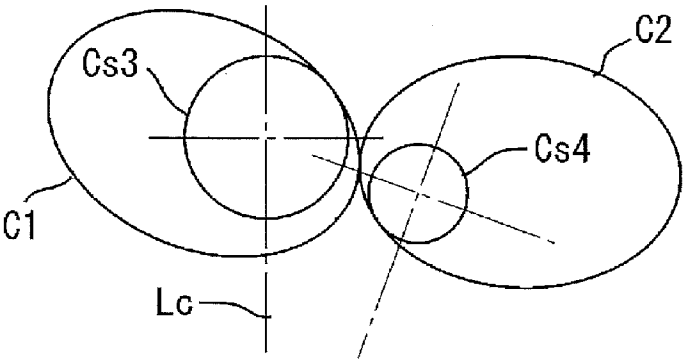
FIG. 4A is a view showing a state where elliptical and true-circular tooth-profile formation circles and small tooth-profile formation circles that form a tooth profile of an inner rotor according to a fourth embodiment of the present invention are combined.
Figure 4B:
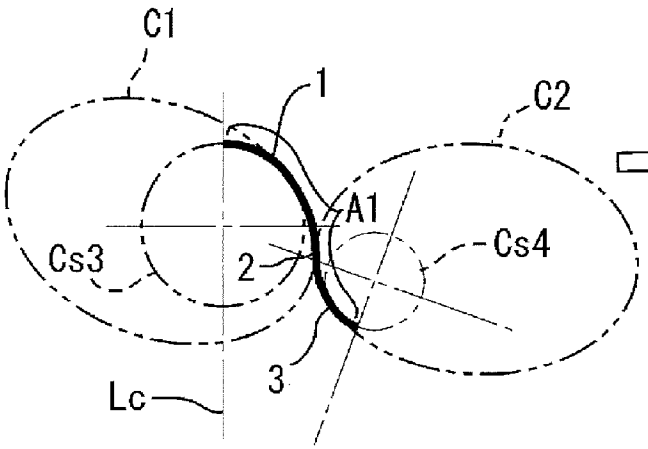
FIGS. 4B and 4C are views showing the steps in which the tooth profile of the inner rotor according to the fourth embodiment is formed from a half-tooth portion of the tooth profile.
Figure 4C:
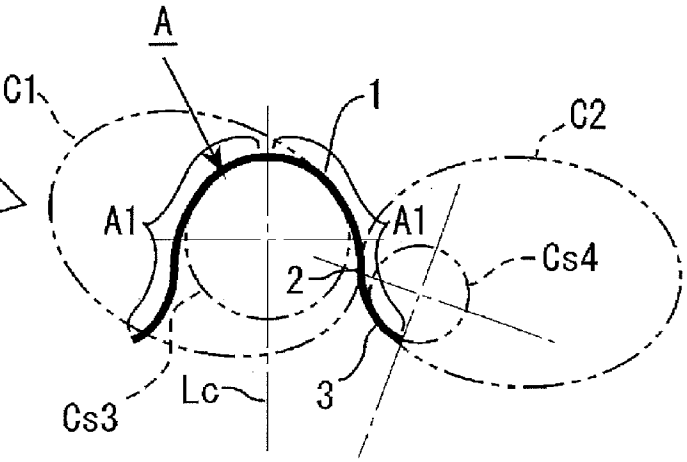

Next, a fourth embodiment of the present invention will be described with reference to FIG. 4. In the fourth embodiment, the half-tooth portion A1 is formed of elliptical and true-circular tooth-profile formation circles C. Specifically, the half-tooth portion A1 is formed of two first and second elliptical tooth-profile formation circles C1 and C2 and two third and fourth small true-circular tooth-profile formation circles Cs3 and Cs4.

Moreover, a portion of the third small true-circular tooth-profile formation circle Cs3 forms the addendum portion 1 of the half-tooth portion A1. Further, a portion of each of the first and second elliptical tooth-profile formation circles C1 and C2 forms the engagement portion 2. Furthermore, the fourth small true-circular tooth-profile formation circle Cs4 forms the dedendum portion 3.

In the configuration of the addendum portion 1, the third small true-circular tooth-profile formation circle Cs3 is included in the first elliptical tooth-profile formation circle C1 that forms the engagement portion 2 so as to be partially in contact with each other, the third true-circular tooth-profile formation circle Cs3 forms the addendum portion 1, and the first elliptical tooth-profile formation circle C1 forms a portion of the engagement portion 2.

Further, the second elliptical tooth-profile formation circle C2 forms the remaining portion of the engagement portion 2, and the fourth small tooth-profile formation circle Cs4 that is included in the second tooth-profile formation circle C2 so as to be partially in contact with each other forms the dedendum portion 3. When the third small trochoidal curve tooth-profile formation circle Cs3 that forms the addendum portion 1, the first and second elliptical tooth-profile formation circles C1 and C2 that form the engagement portion 2, and the fourth small true-circular tooth-profile formation circle Cs4 that forms the dedendum portion 3 are connected smoothly, the half-tooth portion A1 of the tooth profile A of the inner rotor is formed. Moreover, by disposing the half-tooth portions A1 bilaterally symmetrical to the diameter line Lc, it is possible to form the tooth profile A of one tooth of the inner rotor.

Figure 6:
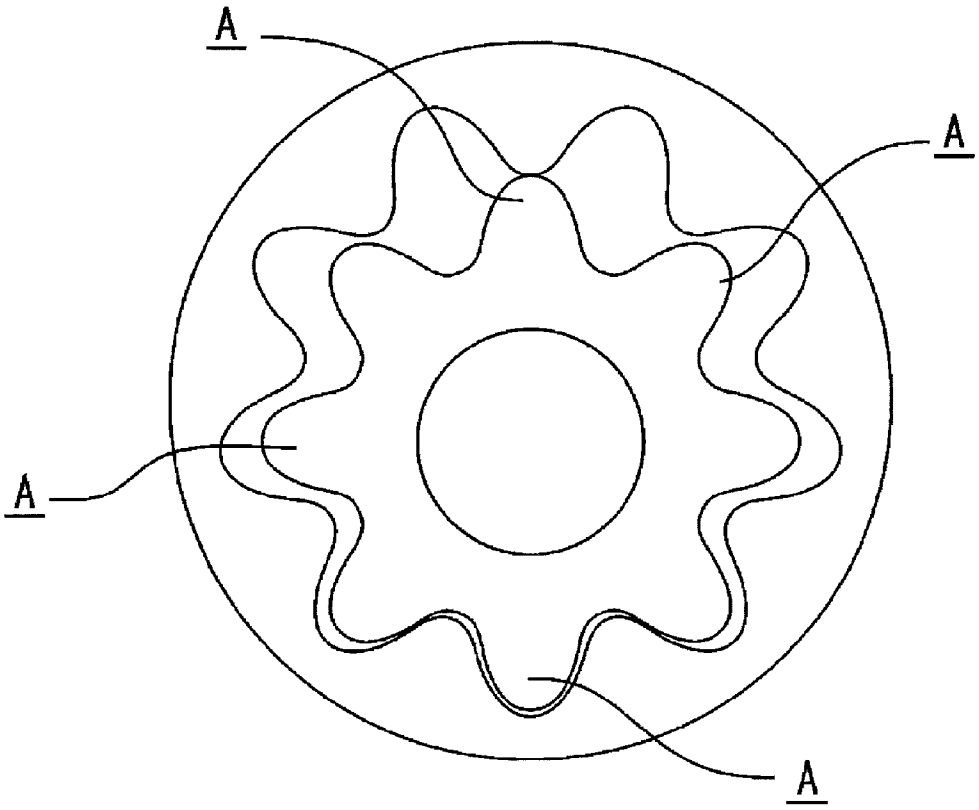
FIG. 6 is a view showing an example of a pump rotor according to the present invention in which an inner rotor having eight teeth and an outer rotor having nine teeth are combined.
Figure 7:
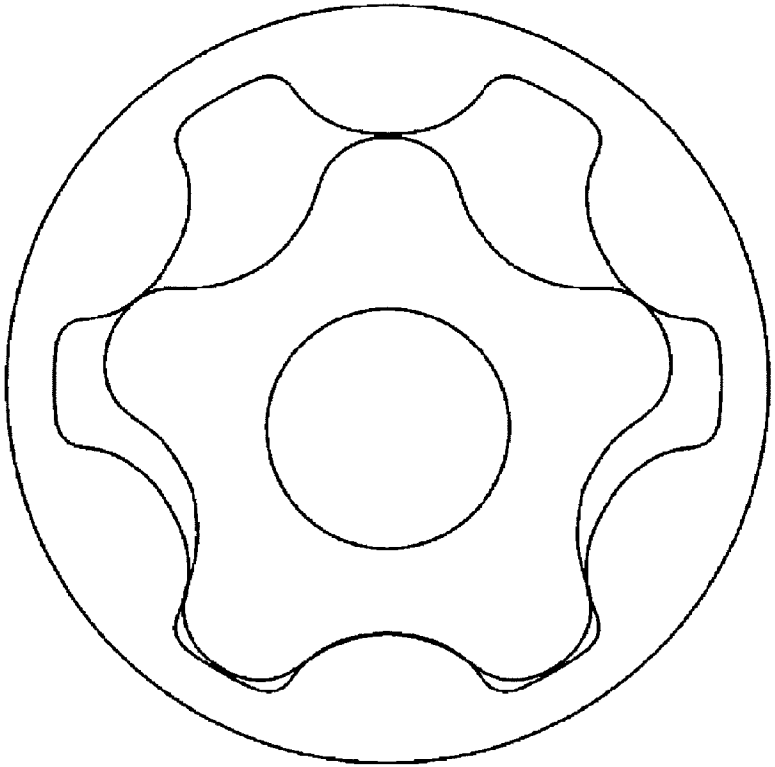
Fig. 7 PRIOR ART
FIG. 7 is a view of a general trochoidal curve pump rotor for comparison with the present invention.

The pump rotor of the present invention and a comparative general trochoidal curve rotor were designed. FIG. 6 shows a pump rotor in which an inner rotor having eight teeth and an outer rotor having nine teeth are combined, as an example of an inventive product according to the present invention. In the inventive product, the tooth profile is formed according to the method of the first embodiment. FIG. 7 shows a comparative product in which a pump rotor having a trochoidal curve tooth profile is used. The specifications of the tooth profiles of the inventive product and the comparative product are shown below.

TABLE 1

Specification Table for Comparison between Tooth Profiles of Inventive Product and Comparative Product

| | Trochoidal Rotor | Related Art (Japanese Patent Application Laid-open No. 2011-17318) | Inventive Product |
|---|---|---|---|
| Number of Teeth (T) | 5/6 | 8/9 | 8/9 |
| Outer Diameter (mm) of Outer Rotor | ϕ60.0 | ϕ60.0 | ϕ60.0 |
| Dedendum Diameter (mm) of Outer Rotor | ϕ52.0 | ϕ52.0 | ϕ52.0 |
| Addendum Diameter (mm) of Outer Rotor | ϕ38.4 | ϕ38.4 | ϕ38.4 |
| Addendum Diameter (mm) of Inner Rotor | ϕ45.2 | ϕ45.2 | ϕ45.2 |
| Dedendum Diameter (mm) of Inner Rotor | ϕ31.6 | ϕ31.6 | ϕ31.6 |
| Rotor Thickness (mm) | 15 | 15 | 15 |
| Amount of Eccentricity (mm) | 3.4 | 3.4 | 3.4 |
| Theoretical Discharge Amount ($cm^3$/rev) | 11.9 | 12.3 | 12.5 |

What is claimed is:

1. A pump rotor which is an inner rotor of an internal gear pump, the inner rotor having a tooth profile, wherein a half-tooth portion of the tooth profile is formed of three tooth-profile formation circles that are elliptical or true-circular, two of the tooth-profile formation circles form a combination of a small tooth-profile formation circle and a large tooth-profile formation circle in which the small tooth-profile formation circle is inscribed and is entirely included, a portion of the small tooth-profile formation circle forms an addendum portion of the half-tooth portion, a portion of the large tooth-profile formation circle in which the small tooth-profile formation circle is inscribed and is entirely included forms an engagement portion of the half-tooth portion, and a portion of another tooth-profile formation circle that circumscribes the large tooth-profile formation circle forms a dedendum portion of the half-tooth portion.

2. The pump rotor according to claim 1, wherein the tooth-profile formation circles are formed of a combination of ellipses only.

3. The pump rotor according to claim 1, wherein the tooth-profile formation circles are formed of a combination of true circles only.

4. The pump rotor according to claim 1, wherein the tooth-profile formation circles are formed of a combination of an ellipse and a true circle.

5. The pump rotor according to claim 1, wherein the small tooth-profile is the smallest tooth-profile of the three tooth-profile formation circles.

6. The pump rotor according to claim 1, wherein a locus of the addendum portion does not project outside in a diameter direction further than the engagement portion of the half-tooth portion.

7. A pump rotor which is an inner rotor of an internal gear pump, the inner rotor having a tooth profile, wherein a half-tooth portion of the tooth profile is formed of four tooth-profile formation circles that are elliptical or true-circular, the four tooth-profile formation circles include first and second combinations, each combination being constituted by two of the tooth-profile formation circles formed of a small tooth-profile formation circle and a large tooth-profile formation circle in which the small tooth-profile formation circle is inscribed and is entirely included, a portion of the small tooth-profile formation circle of the first combination forms an addendum portion of the half-tooth portion, a portion of the small tooth-profile formation circle of the second combination forms a dedendum portion the half-tooth portion, and a portion of the other large tooth-profile formation circle forms an engagement portion of the half-tooth portion while circumscribing.

8. The pump rotor according to claim 7, wherein the tooth-profile formation circles are formed of a combination of ellipses only.

9. The pump rotor according to claim 7, wherein the tooth-profile formation circles are formed of a combination of true circles only.

10. The pump rotor according to claim 7, wherein the tooth-profile formation circles are formed of a combination of an ellipse and a true circle.

11. The pump rotor according to claim 7, wherein the small tooth-profile formation circle of the first combination is the smallest tooth-profile of the four tooth-profile formation circles.

12. A pump rotor which is an inner rotor of an internal gear pump, the inner rotor having a tooth profile, wherein a half-tooth portion of the tooth profile is formed a plurality of tooth-profile formation circles that are elliptical or true-circular, two of the plurality of tooth-profile formation circles form a combination of a small tooth-profile formation circle and a large tooth-profile formation circle in which the small tooth-profile formation circle is inscribed and is entirely included, a portion of the small tooth-profile formation circle forms an addendum portion of the half-tooth portion, a portion of the large tooth-profile formation circle in which the small tooth-profile formation circle is inscribed and is entirely included forms an engagement portion of the half-tooth portion, and a portion of another tooth-profile formation circle of the plurality of tooth-profile formation circles that circumscribes the large tooth-profile formation circle forms a dedendum portion of the half-tooth portion.

13. The pump rotor according to claim 12, wherein the small tooth-profile is the smallest tooth-profile of the plurality of tooth-profile formation circles.

* * * * *